US008126176B2

(12) United States Patent
Iwano et al.

(10) Patent No.: US 8,126,176 B2
(45) Date of Patent: Feb. 28, 2012

(54) HEARING AID

(75) Inventors: Kenji Iwano, Kanagawa (JP); Atsunobu Murase, Kanagawa (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/935,687

(22) PCT Filed: Jan. 27, 2010

(86) PCT No.: PCT/JP2010/000471

§ 371 (c)(1),
(2), (4) Date: Sep. 30, 2010

(87) PCT Pub. No.: WO2010/089976

PCT Pub. Date: Aug. 12, 2010

(65) Prior Publication Data

US 2011/0013792 A1 Jan. 20, 2011

(30) Foreign Application Priority Data

Feb. 9, 2009 (JP) ..... 2009-027145

(51) Int. Cl.
*H04R 25/00* (2006.01)

(52) U.S. Cl. ..... 381/317; 381/318; 381/321

(58) Field of Classification Search ..... 381/312, 381/317, 318, 321, 23.1
See application file for complete search history.

(56) References Cited

U.S. PATENT DOCUMENTS

| | | | |
|---|---|---|---|
| 4,887,299 | A | 12/1989 | Cummins et al. |
| 6,094,489 | A | 7/2000 | Ishige et al. |
| 2005/0141737 | A1 | 6/2005 | Hansen |
| 2005/0175198 | A1 | 8/2005 | Neumann |
| 2008/0159573 | A1 | 7/2008 | Dressler et al. |
| 2008/0181439 | A1 | 7/2008 | Neumann |
| 2009/0304215 | A1 | 12/2009 | Hansen |
| 2011/0013791 | A1 | 1/2011 | Griffin et al. |

FOREIGN PATENT DOCUMENTS

| | | |
|---|---|---|
| AU | 766876 | 1/2001 |
| CA | 2 385 812 A1 | 1/2001 |
| CA | 2 385 812 C | 1/2001 |
| EP | 1 111 960 | 6/2001 |
| JP | 62-17800 | 1/1987 |
| JP | 2-502151 | 7/1990 |
| JP | 5-173592 | 7/1993 |
| JP | 10-94095 | 4/1998 |
| JP | 2001-128296 | 5/2001 |
| JP | 3345534 | 8/2002 |
| JP | 2004-158986 | 6/2004 |

(Continued)

OTHER PUBLICATIONS

James M. Kates, "Digital Hearing Aids", (Plural Publishing, Inc.), pp. 270-271.

(Continued)

*Primary Examiner* — Tuan Nguyen
(74) *Attorney, Agent, or Firm* — Wenderoth Lind & Ponack, L.L.P.

(57) ABSTRACT

A hearing aid comprises a noise suppressor that calculates noise suppression gain, an adjustment amount calculator that calculates an adjustment amount on the basis of a signal strength and a noise component strength, and a nonlinear compressor that calculates a reference gain on the basis of a signal strength and specific reference gain information and adjusts the reference gain on the basis of an adjustment amount, thereby calculating a nonlinear compression gain.

20 Claims, 9 Drawing Sheets

FOREIGN PATENT DOCUMENTS

| | | |
|---|---|---|
| JP | 3794881 | 4/2006 |
| JP | 3894875 | 12/2006 |
| JP | 3914768 | 2/2007 |
| WO | 89/04583 | 5/1989 |
| WO | 01/01731 | 1/2001 |
| WO | 01/01732 | 1/2001 |
| WO | 03/081947 | 10/2003 |
| WO | 2004/008801 | 1/2004 |
| WO | 2008/116264 | 10/2008 |

OTHER PUBLICATIONS

Supplementary European Search Report issued Mar. 7, 2011 in Application No. EP 10 73 8319.

International Search Report issued Mar. 2, 2010 in International (PCT) Application No. PCT/JP2010/000471.

Written Opinion of the International Searching Authority issued Mar. 2, 2010 in International (PCT) Application No. PCT/JP2010/000471.

HEARING AID

BACKGROUND OF THE INVENTION

1. Technical Field

The present invention relates to a hearing aid that combines noise suppression processing with nonlinear compression processing.

2. Background Art

A conventional hearing aid comprises an A/D converter for converting analog input signals produced according to input sound into digital input signals, a frequency characteristic processing means for adjusting the frequency characteristics of digital input signals, an amplifier for amplifying digital input signals, a D/A converter for converting digital input signals into analog sound signals and outputting the analog sound signals, a control signal input/output means for inputting and outputting control signals, and so forth.

With a conventional hearing aid, however, inputted sound is amplified without making any distinction between speech and sounds other than speech, and the amplified sound is outputted to the person wearing the hearing aid. Accordingly, when environmental noise other than speech becomes loud, this may become uncomfortable for the person wearing the hearing aid. In view of this, technology has been proposed for controlling the outputted sound by taking ambient sound into account.

For example, a technique has been proposed in which noise is suppressed by spectrum subtraction (SS), and the amplification ratio is varied according to the ratio between the signal power in a non-speech segment and the signal power of the inputted sound (see, for example, Patent Literature 1). Spectrum subtraction is a noise suppression processing method in which just the noise component is subtracted from a digital input signal by statistical estimation of the noise level of a non-speech segment.

Another technique has been proposed in which the compression and amplification characteristics are varied by detecting the degree of steadiness of environmental noise (see, for example, Patent Literature 2). The degree of steadiness referred to here is an index that expresses short-term fluctuations in power. In general, steady noise with little power fluctuation, such as at an air-conditioning equipment, has a high degree of steadiness, while noise that fluctuates sharply in power, such as in a sheet-metal plant, has a low degree of steadiness.

Another technique has been proposed in which the system switches between directional control and spectrum subtraction according to the environmental noise (see, for example, Patent Literature 3). Directional control is executed using a directional microphone or a plurality of non-directional microphones. When a directional microphone is used, the SN ratio (signal to noise ratio) can be improved by lowering the sensitivity of the microphone in everything but the forward direction, while leaving the sensitivity unchanged in the forward direction. When a plurality of non-directional microphones are used, sound from ahead can be emphasized by correcting any offset in the time at which speech was inputted to the plurality of microphones, and adding together the plurality of input signals.

Yet another technique has been proposed in which, in directional control, the system smoothly switches the sound reception characteristics of the hearing aid between omnidirectional characteristics and directional characteristics (see, for example, Patent Literature 4). Switching the sound reception characteristics is accomplished by performing controlled attenuation of a signal derived from the input signals (Xfront and Xback) from first and second microphones, and controlled retardation of time or phase, and then producing an overall synthetic signal (Y) by using an adjustable attenuation control parameter (omni) and retardation (T).

CITATION LIST

Patent Literature

Patent Literature 1: Japanese Patent 3,345,534
Patent Literature 2: Japanese Patent 3,794,881
Patent Literature 3: Japanese Patent 3,894,875
Patent Literature 4: Japanese Patent 3,914,768

With the prior art discussed above, however, when noise suppression processing by spectrum subtraction is followed by nonlinear compression processing (NLC), noise that had been suppressed by spectrum subtraction ends up being amplified.

The present invention was conceived in light of the above situation, and it is an object thereof to provide a hearing aid with which noise suppression processing and nonlinear compression processing are combined so that speech can be clearly heard.

SUMMARY OF THE INVENTION

The hearing aid of the present invention comprises a microphone for producing an input signal from input sound;

a noise suppressor for estimating the noise component strength included in the input signal on the basis of the signal strength for each of a plurality of frequency bands in the input signal, and calculating for each of the plurality of frequency bands a noise suppression gain for suppressing the noise component strength, an adjustment amount calculator for calculating an adjustment amount on the basis of the signal strength and the noise component strength, a reference gain information memory for storing specific reference gain information, a nonlinear compressor for calculating a reference gain on the basis of the signal strength and the specific reference gain, and adjusting the reference gain on the basis of the adjustment amount, and thereby calculating for each of the plurality of frequency bands a nonlinear compression gain for nonlinearly compressing and amplifying the input signal, a controller for producing an output signal by controlling the input signal on the basis of the noise suppression gain and the nonlinear compression gain, and a receiver for reproducing an output sound from the output signal.

The present invention provides a hearing aid with which noise suppression processing and nonlinear compression processing are combined so that speech can be clearly heard.

DETAILED DESCRIPTION OF THE INVENTION

With the hearing aid pertaining to an embodiment of the present invention, noise suppression processing (NS) is performed to suppress the noise component included in an input signal, after which nonlinear compression processing (NLC) is performed to amplify the input signal with a different gain (amplification ratio) for each frequency band.

First Embodiment

Constitution of Hearing Aid

Figure 1:
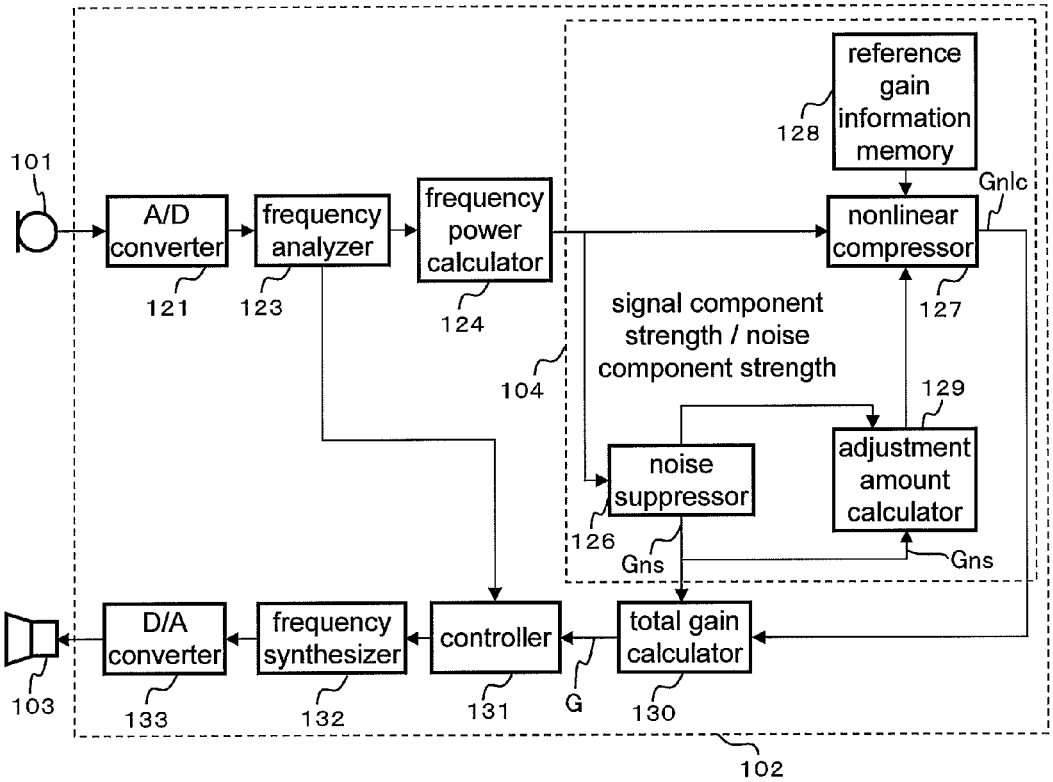
FIG. 1 is a block diagram illustrating an example of the constitution of a hearing aid pertaining to a first embodiment of the present invention.

FIG. 1 shows the constitution of the hearing aid pertaining to the first embodiment of the present invention. The hearing aid pertaining to this embodiment has a microphone 101 that produces an analog input signal from input sound, a signal processing means 102 for producing an analog output signal by subjecting the analog input signal to specific signal processing, and a receiver 103 that reproduces an output sound from the analog output signal.

The signal processing means 102 has an A/D converter 121, a frequency analyzer 123, a frequency power calculator 124, a noise suppressor 126, a nonlinear compressor 127, a reference gain information memory 128, an adjustment amount calculator 129, a total gain calculator 130, a controller 131, a frequency synthesizer 132, and a D/A converter 133.

The A/D converter 121 converts the analog input signal produced by the microphone 101 into a digital input signal processed by the signal processing means 102. In the description of the signal processing means 102, the digital input signal will hereinafter be referred to simply as an "input signal." In this embodiment, we will assume that the desired signal included in the input signal is a speech signal. A speech signal includes a component corresponding to the voice emitted by humans, such as conversation sounds, singing voices, and so forth, and a component corresponding to a human voice that has gone through a machine, such as a voice on the telephone, a television voice, and so forth.

The frequency analyzer 123 divides the input signal into specific time segments, and converts a time-domain input signal into a frequency-domain input signal. Examples of conversion into frequency-domains include FFT (fast Fourier transform), and sub-band coding.

The frequency power calculator 124 calculates the frequency power (signal strength) for each frequency band from the real part and the imaginary part of the frequency-domain input signals. Examples of the method for calculating frequency power include the RMS (root mean square) and a method in which the squares of the real part and the imaginary part are summed, but other methods can be used instead.

The noise suppressor 126 calculates the signal component strength of the input signal on the basis of the frequency power for each frequency band outputted from the frequency power calculator 124, and estimates the noise component strength included in the input signal. The noise suppressor 126 computes a noise suppression gain Gns for suppressing the noise component of the input signal on the basis of the estimated signal component strength and the noise component strength. The noise suppressor 126 will be discussed in further detail below.

The adjustment amount calculator 129 calculates the adjustment amount used in adjusting the reference gain (discussed below), for each frequency band, on the basis of the noise suppression gain Gns, the noise component strength, and the signal component strength estimated by the noise suppressor 126. The calculated adjustment amount is outputted to the nonlinear compressor 127. The operation of the adjustment amount calculator 129 will be discussed in further detail below.

The nonlinear compressor 127 determines a nonlinear compression gain Gnlc for each frequency segment on the basis of the frequency power for each frequency band outputted from the frequency power calculator 124, the adjustment amount calculated by the adjustment amount calculator 129, and a reference gain information stored in the reference gain information memory 128. More specifically, the nonlinear compressor 127 computes the reference gain corresponding to the frequency power for each frequency band by referring to reference gain information. The nonlinear compressor 127 then multiplies the reference gain by the adjustment amount to calculate the nonlinear compression gain Gnlc for each frequency band.

Figure 8:
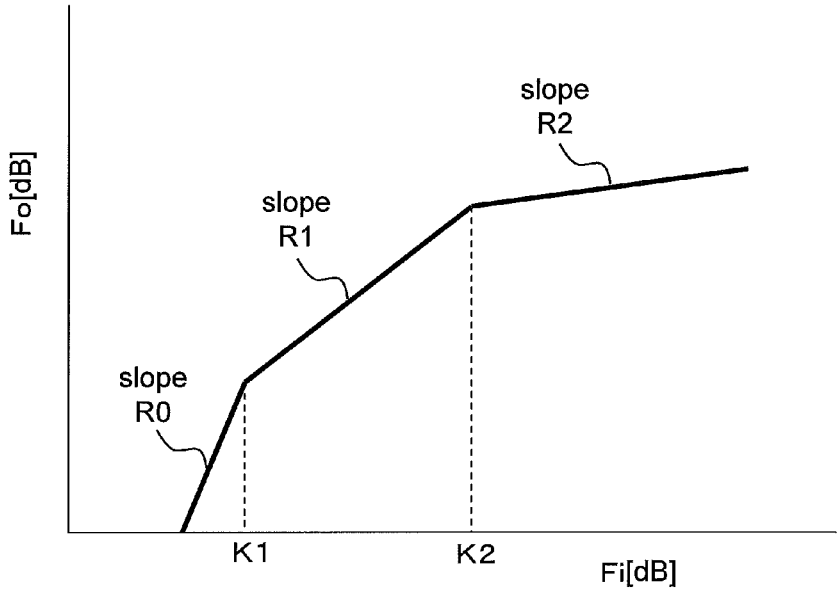
FIG. 8 is an example of a reference gain utilized by the nonlinear compressor pertaining to the first embodiment of the present invention.

The reference gain information here refers a nonlinear compression function determined according to the hearing level of the hearing aid user. FIG. 8 is an example of reference the gain information utilized by the nonlinear compressor 127. With the reference gain derived from the reference gain information, the input signal is amplified or compressed in the direction of ameliorating the decrease in hearing level and the narrowing of the dynamic range (audible range). The reference gain information is stored in the reference gain information memory 128 ahead of time for each frequency segment. The nonlinear function and the operation of the nonlinear compressor 127 will be described in detail below.

The total gain calculator 130 calculates a total gain G ($G=Gnlc \times Gns$) on the basis of the nonlinear compression gain Gnlc calculated by the nonlinear compressor 127 and the noise suppression gain Gns calculated by the noise suppressor 126.

The controller 131 amplifies the input signal with the total gain G More specifically, the controller 131 amplifies the frequency-domain input signals by multiplying the total gain G for each frequency segment by the frequency-domain input signal produced by the frequency analyzer 123. Consequently, the controller 131 produces an output signal.

The frequency synthesizer 132 synthesizes an output signal for each amplified frequency. More specifically, the frequency synthesizer 132 converts the frequency-domain output signal into a time-domain output signal by IFFT (inverse FFT), for example.

The D/A converter 133 converts the output signal produced by the signal processing means 102, that is, a digital output signal, into an analog output signal.

FIG. 8 is an example of the nonlinear compression function used by the nonlinear compressor 127, and will be described using FIG. 5 in WO H2-502151 as an example. The horizontal axis is Fi, which is the logarithmic amplitude envelope (dB) of the sound pressure level of the input signal, and the vertical axis is Fo, which is the logarithmic amplitude envelope (dB) of the output signal. First, when the input signal level is low, an adaptable amplifier imparts increasing gain to the input signal. Specifically, the slope RO of the Fi-Fo curve is set to be greater than one in order to expand the input signal. Consequently, low-level background noise is attenuated with respect to a speech signal.

When the input signal level exceeds the selected level displayed as K1, the adaptable amplifier imparts linear gain to the input signal. Specifically, the slope R1 of the Fi-Fo curve is preferably about one. Consequently, a gain function that is suited to the hearing level of the individual hearing aid user is selected for an input signal having an amplitude in the normal speech segment.

Furthermore, when the input signal level exceeds the selected level displayed as K2 in FIG. 8, the adaptable amplifier reduces the linear portion of the gain curve below one, and thereby compresses the input signal. This K2 level is preferably selected so that signals that exceed the MCL (most comfortable level), which is the sound pressure level at which the user feels most comfortable, are compressed. Therefore, the three linear portions of the input/output curve in FIG. 8 act such that weak signals are expanded, ordinary speech signals are amplified as usual, and strong signals are compressed.

With the nonlinear compressor 127, however, compression and expansion are performed according to the level of the input signal, regardless of the SN ratio (the ratio of the signal component strength and noise component strength) or whether a segment is a speech segment or a non-speech segment. Accordingly, noise that is a non-speech signal may end up being expanded, or a speech signal may end up being compressed, for example. Solving this problem is a characteristic feature of the hearing aid pertaining to this embodiment.

Constitution of Noise Suppressor 126

Figure 2:
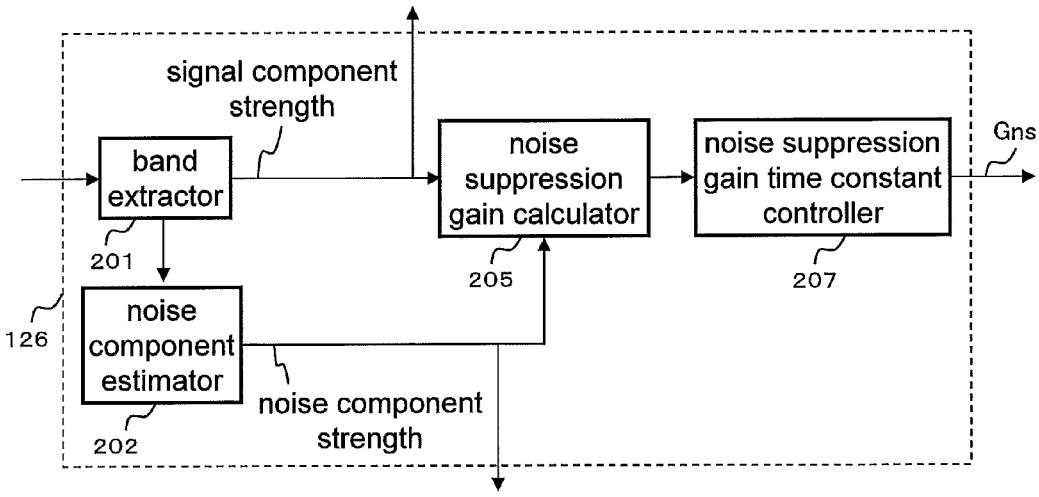
FIG. 2 is a block diagram illustrating an example of the constitution of a noise suppressor of the hearing aid pertaining to the first embodiment of the present invention.

FIG. 2 is a diagram of the constitution of the noise suppressor 126 pertaining to the first embodiment of the present invention. The noise suppressor 126 has a band extractor 201, a noise component estimator 202, a nonlinear compression gain calculator 205, and a nonlinear compression gain time constant controller 207.

The flow of processing by the noise suppressor 126 will now be described through reference to FIG. 2.

The band extractor 201 acquires the frequency power calculated by the frequency power calculator 124 (here, both a speech component and a noise component may be included as the signal component of frequency power). The band extractor 201 sets as the signal component strength the results of computation in which the frequency power for every frequency band are compiled for every frequency segment on the basis of the frequency segment for which the noise suppression gain Gns (discussed below) is calculated. The frequency segment here is composed of a single frequency band or a plurality of frequency bands.

Next, at the noise component estimator 202, the noise component strength is estimated from the frequency power for every frequency segment. An example of a method for estimating the noise component will be described. One possible estimation method is to focus on the fact that the frequency power fluctuates in the time axis direction. More specifically, when the frequency power is falling, it is used as the noise component strength, and when the frequency power is rising, the value of the frequency power one unit of time earlier is multiplied by a specific constant (a value slightly greater than one). This estimation method is called "minimum hold." The one unit of time may be, for example, the time period during which frequency analysis is performed, or one-half this time period in order to overlap frequency analysis processing, but other units may be used instead.

The nonlinear compression gain calculator 205 calculates the noise suppression gain Gns on the basis of the SN ratio calculated from the signal component strength and noise component strength. For example, it can be calculated as noise suppression gain Gns=((signal component strength−noise component strength)÷signal component strength). The noise suppression gain Gns here satisfies the relation $0<Gns\leqq 1$. In this description, we will assume the minimum value of the noise suppression gain Gns to be a value close to zero, but that is not necessarily the case. For instance, if an odd noise called musical noise should be caused by noise suppression processing as a result of the extent of noise suppression being large, the generation of this odd noise can be reduced by setting the minimum value of the noise suppression gain Gns to a value closer to one than zero. Depending on the method by which an estimate of the noise component strength is calculated, the noise suppression gain Gns may be a negative value or less than the minimum value, but in this case the noise suppression gain Gns should be set to the minimum value.

The nonlinear compression gain time constant controller 207 performs time constant control over the noise suppression gain Gns. When a large amount of signal component such as speech is included in the input signal, the nonlinear compression gain time constant controller 207 shortens the time constant at which the noise suppression gain Gns is controlled in the increasing direction, and lengthens the time constant in which it is controlled in the decreasing direction. This prevents the speech signal included in the input signal from being suppressed by the noise suppressor, and allows for rapid response to setting that goes through the speech component when speech has been resumed after the speech signal is cut off. Meanwhile, when a large amount of noise component is included in the input signal, the nonlinear compression gain time constant controller 207 shortens the time constant at which the noise suppression gain Gns is controlled in the decreasing direction, and lengthens the time constant in which it is controlled in the increasing direction. This allows the system to handle sudden noises with large time fluctuations. Also, in a sound environment in which steady noise is dominant, fluctuation in the level of noise suppression gain can be reduced, so it is possible to provide a sound that is easier to hear.

The noise suppressor 126 may also utilize Wiener filtering, in which suppression processing is performed so that the strength of the noise component is attenuated. When noise is suppressed by Wiener filtering, the Wiener filter is provided to the noise suppressor 126, and the waveform of the filter output is made as similar as possible to the waveform of the filter input that includes no noise component. Also, when noise suppression is performed by spectrum subtraction, noise suppression is accomplished by subtracting the signal of the non-speech component (that is, the signal of just the noise component) from an input signal that includes a speech component and a noise component. This allows the signal strength of the noise component to be attenuated.

Operation of Adjustment Amount Calculator 129

Figure 3:
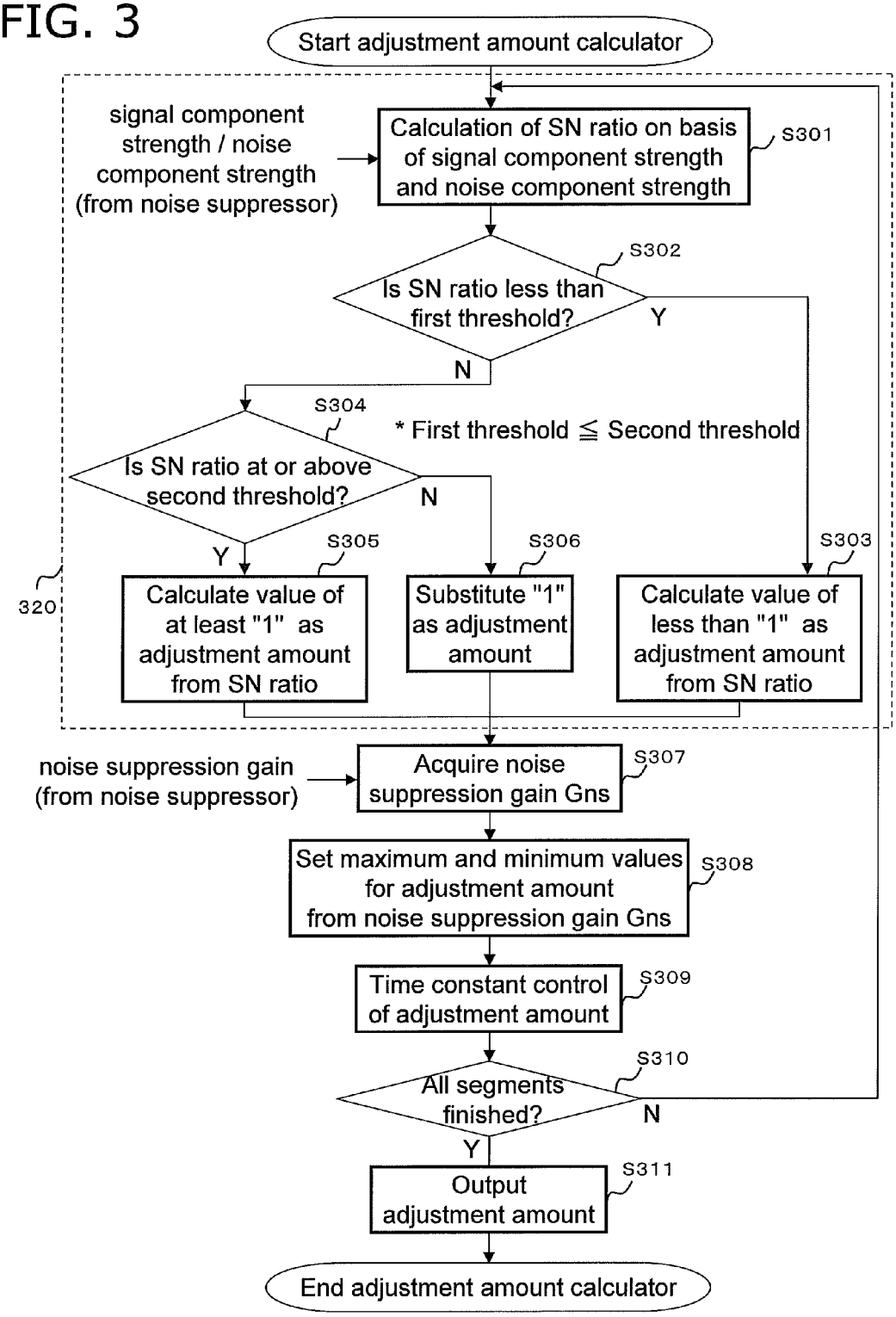
FIG. 3 is a flowchart illustrating an example of the operation of an adjustment amount calculator of the hearing aid pertaining to the first embodiment of the present invention.

FIG. 3 is a flowchart illustrating an example of the operation of the adjustment amount calculator 129 pertaining to the first embodiment of the present invention.

Before starting, the default value of the adjustment amount is set to "1".

First, the SN ratio is calculated on the basis of the signal component strength and noise component strength acquired from the noise suppressor 126 (step S301). Then, it is determined whether or not the calculated SN ratio is less than a first threshold (step S302). If the SN ratio is less than the first threshold, a value less than "1" is calculated as the adjustment amount from the SN ratio (step S303). That is, if the SN ratio is lower than the first threshold, processing is performed to reduce the adjustment amount. On the other hand, if the SN ratio in step S302 is at or above the first threshold, it is determined whether or not the SN ratio is less than a second threshold (step S304). If the SN ratio is at or above the second threshold, a value of at least "1" is calculated as the adjustment amount from the SN ratio (step S305). That is, if the SN ratio is higher than the second threshold, processing is performed to increase the adjustment amount. If the SN ratio is at or above the first threshold and less than the second threshold, the value "1" is substituted as the adjustment amount. That is, the adjustment amount is not increased or decreased. The first threshold shall be no higher than the second threshold.

After the adjustment amount has been calculated or substituted in steps S303, S305, and S306, the noise suppression gain Gns is acquired from the noise suppressor 126 (step S307). Then, the maximum and minimum values for the adjustment amount are set on the basis of the noise suppression gain Gns (step S308). The adjustment amount is then subjected to time constant control (step S309). It is then determined whether or not the processing of steps S301 to S309 has ended for all the frequency segments (all bands) (step S310). If it has not ended for all frequency segments, the flow returns to step S301 to perform processing on any unprocessed frequency segments. If the processing has ended for all the frequency segments, the adjustment amount is outputted to the nonlinear compressor 127 (step S311).

Along with setting the minimum value of the adjustment amount in step S303, the maximum value may also be set in step S305. An example of a method for setting the minimum value of the adjustment amount is a method in which the value at which the product of the adjustment amounts and the noise suppression gains Gns calculated for every specified time segment is at its minimum is set to be the minimum value of the adjustment amount. To put this another way, the value obtained by dividing the minimum value of the noise suppression gain Gns by the noise suppression gain Gns is used as the minimum value for the adjustment amount. The purpose of performing this setting is to match the minimum value of the adjustment amount to the maximum suppression amount possible with noise suppression processing.

An example of a method for setting the maximum value for the adjustment amount is a method in which the value of the adjustment amount when the product of the adjustment amount and the noise suppression gain Gns for a certain frequency segment is 1 is set to be the maximum value for the adjustment amount. To put this another way, the inverse of the noise suppression gain Gns calculated for every specific time segment is set to be the maximum value for the adjustment amount. The purpose of performing this setting is that, when a specific time segment in which a speech signal is included is taken into account in noise suppression processing, a speech signal that has been suppressed by noise suppression processing can be restored to the amplification level of the input signal.

In steps S307 and S308, the maximum and minimum values for the adjustment amount may be set without using the noise suppression gain Gns. For example, the maximum and minimum values for the adjustment amount may be set to specific default values. In this case, there is no need for comparative computation of the adjustment amount by frequency band, so the power consumption of the hearing aid can be reduced.

In steps S302 and S304, two thresholds for comparing the SN ratio are readied, so that the step of setting the adjustment amount is classified into three steps, namely, a step of setting to a value of at least 1, a step of setting to 1, and a step of setting to a value less than 1, but this is not necessarily the case. For example, just one threshold may be readied, so that the step of setting the adjustment amount is classified into two steps. In this case, when the SN ratio is at or above the threshold, the adjustment amount may be set to 1 or more, and when the SN ratio is less than the threshold, the adjustment amount may be set to less than 1.

The first and second thresholds may be set so that the loudness levels for the various frequency bands are constant. Doing this makes it possible to clearly hear speech, according to the sense of the hearing aid user. The loudness level is a numerical value that corresponds to a curve group produced by using 1000 Hz pure sound as a reference in 10 dB units, and finding the sound pressure level for pure sound of another frequency that sounds equally loud as sound of that sound pressure level. The unit of loudness is the phon.

The first threshold and second threshold may each be set to a different value for every frequency band. In this case, the first and second thresholds can be determined on the basis of a comparison between the frequency characteristics of typical speech and the frequency characteristics of steady noise (such as traffic noise or crowd noise).

As to the frequency characteristics of speech and the frequency characteristics of steady noise, examples are given in the book "Digital Hearing Aids," written by James M. Kates (Plural Publishing, Inc.), in FIG. 9-7. The frequency characteristics of speech have a tendency for the power spectrum to be concentrated in a low frequency band of approximately 800 Hz or less. The frequency characteristics of traffic noise has a tendency for the power spectrum to gradually decrease at 1/f with respect to an increase in the frequency f. Accordingly, when the SN ratio is compared for different frequency bands, at a low frequency band of 800 Hz or less the SN ratio tends to be good, whereas the SN ratio tends to be poor in high frequency bands. In particular, in a frequency band of from 1 to 6 kHz, the SN ratio tends to be poor even though word sound information is included.

When the above frequency characteristics are taken into consideration, the first threshold and second threshold are preferably each set to a small value on the high frequency band side, along with being set to a large value on the low frequency band side. This allows the timing at which the degree of the SN ratio is decided to be made closer for the low frequency band side and the high frequency band side, so the resulting output sound makes it easier to hear words.

Also, the first threshold and second threshold may each be set uniformly to all frequency bands on the basis of the SN ratio on the low frequency band side. As discussed above, the frequency characteristics of speech are such that the power spectrum is concentrated on the low frequency band side, and the signal strength is particularly strong at the first formant frequency (at least 200 Hz and no higher than 800 Hz).

Accordingly, even in a sound environment with a low SN ratio, there is a high probability that the SN ratio in a frequency band or no higher than 800 Hz, which is the upper limit for the first formant frequency, will be greater than the SN ratio in other frequency bands. The word sound information of speech is included between 200 Hz and 6 kHz. Therefore, by using a SN ratio detected on the low frequency band side of speech (the vowel portion), the high frequency band side (the consonant portion) can be prevented from being buried in noise in a sound environment with a low SN ratio. As a result, an output sound can be provided that makes it easier to hear words.

Also, the adjustment amount may be set to different values for the various frequency bands. For instance, the adjustment amount may be set large in the frequency band that includes the word sound information of speech (200 Hz to 6 kHz) out of the entire frequency band, and the adjustment amount may be set small in the frequency band that does not include the word sound information of speech (less than 200 Hz, and 6 kHz and above) out of the entire frequency band. This allows the frequency band that includes the word sound information of speech to be amplified, so output sound can be provided that makes words easier to hear.

The minimum value of the adjustment amount may be set to different values for the various frequency bands. For example, the minimum value of the adjustment amount in the frequency band that includes the word sound information of speech is set to be smaller than the minimum value of the adjustment amount in other frequency bands. This lowers the effectiveness of noise suppression control on speech signals in the frequency band that includes the word sound information of speech. Accordingly, noise suppression control causes less deterioration in speech signals, so output sound can be provided that makes words easier to hear.

Operation of Nonlinear Compressor 127

Figure 4:
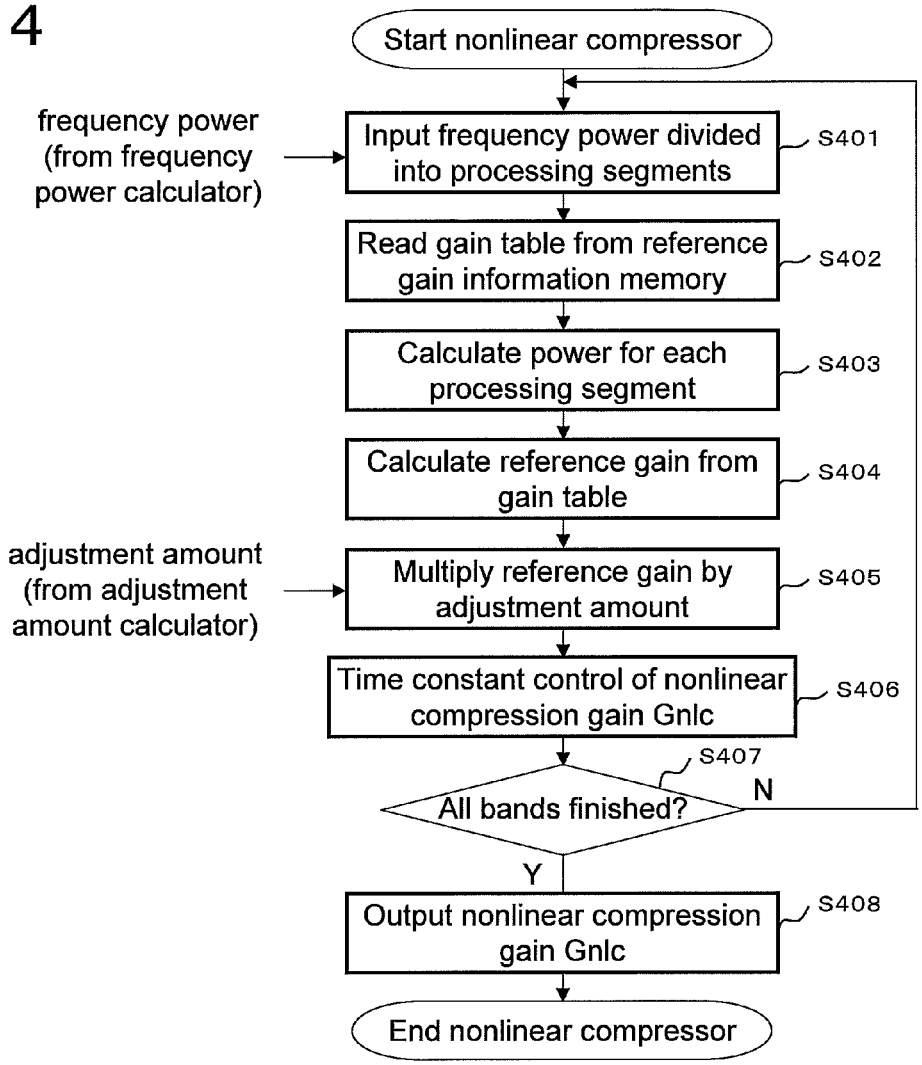
FIG. 4 is a flowchart illustrating an example of the operation of a nonlinear compressor of the hearing aid pertaining to the first embodiment of the present invention.

FIG. 4 is a flowchart illustrating an example of the operation of the nonlinear compressor 127 pertaining to the first embodiment of the present invention First, frequency power divided up for the various frequency segments is acquired from the frequency power calculator 124 (step S401). Reference gain information is then read from a reference gain information memory 402 (step S402). The frequency power is then calculated for every frequency processing segment (step S403). The reference gain corresponding to the calculated frequency power is then calculated by referring to a reference gain table (step S404). An adjustment amount is then acquired from the adjustment amount calculator 129, and the adjustment amount is multiplied by the reference gain to acquire a nonlinear compression gain Gnlc (step S405). Time constant control is then performed on the nonlinear compression gain Gnlc (step S406). It is then determined whether or not the processing of steps S401 to S406 has ended for all frequency segments (step S407). If it has not ended for all frequency segments, the flow returns to step S401 to perform processing on any unprocessed frequency segments. If the processing has ended for all the frequency segments, the nonlinear compression gain Gnlc is outputted to the total gain calculator 130 (step S408).

In step S405, it was described that the adjustment amount is multiplied by the reference gain, but the adjustment amount may instead be added to the reference gain. In this case, the default value of the adjustment amount is "0," the adjustment amount is made a positive value in the case of increasing, made a negative value in the case of decreasing and set to "0" in the case of no change.

In step S406, time constant control is performed on the nonlinear compression gain Gnlc. With standard time constant control of nonlinear compression gain, when the input signal level is increased, the time constant that controls the nonlinear compression gain Gnlc in the direction of decreasing is set shorter, and when the input signal level is decreased, the time constant that controls the nonlinear compression gain Gnlc in the direction of increasing is set shorter. This protects the hearing of the user against input sound bursts.

Here, in the time constant control pertaining to this embodiment, when the input signal has a large signal component, or when a speech segment is detected in the input signal, the time constant that controls the nonlinear compression gain Gnlc in the direction of decreasing is set longer, and the time constant that controls the nonlinear compression gain Gnlc in the direction of increasing is set shorter. The purpose of this is to suppress the cutoff of consonants at the start of a conversation in a speech signal. On the other hand, if the input signal has a large noise component, or if a non-speech segment is detected in the input signal, the time constant that controls the nonlinear compression gain Gnlc in the direction of decreasing is set shorter, and the time constant that controls the nonlinear compression gain Gnlc in the direction of increasing is set longer. Specifically, standard time constant control based on the standpoint of hearing protection is introduced to the segment with a large noise component. This protects hearing while allowing the cutoff of speech segments to be suppressed, so output sound that makes it easier to hear words can be provided.

In this embodiment, time constant control of the noise suppression gain Gns by the noise suppressor 126, and time constant control of the nonlinear compression gain Gnlc by the nonlinear compressor 127 were performed, but this is not the only possibility. For example, time constant control may be performed on the total gain G, which is the product of the noise suppression gain Gns and the nonlinear compression gain Gnlc.

Also, although not touched upon directly in this embodiment, the number of frequency band segments in the nonlinear compressor 127 may be different from the number of frequency band segments in the adjustment amount calculator 129. For instance, the number of frequency band segments in the nonlinear compressor 127 may be smaller than the number of frequency band segments in the adjustment amount calculator 129. In this case, the nonlinear compressor 127 may control the nonlinear compression gain Gnlc with a value that is proportional to the average value of the adjustment amount for each frequency band segment in the adjustment amount calculator 129.

Action and Effect (1) The hearing aid pertaining to this embodiment comprises a noise suppressor that calculates the noise suppression gain for each frequency band, an adjustment amount calculator that calculates an adjustment amount for each frequency band on the basis of signal strength and noise component strength, and a nonlinear compressor that calculates the nonlinear compression gain for each frequency band by adjusting with an adjustment amount the reference gain calculated on the basis of signal strength and reference gain information. With this constitution, gain is controlled by establishing an adjustment amount and a nonlinear compression gain on the basis of reference gain, a noise component, and a speech component for an input signal, and nonlinear compression processing is performed on the basis of the controlled gain. Accordingly, speech output can be optimally controlled according to the speech component and the noise component by combining noise suppression processing with nonlinear compression processing, so suppressed noise can be prevented from being amplified.

(2) Also, with the hearing aid pertaining to this embodiment, the adjustment amount calculator controls so as to decrease the adjustment amount when the ratio between signal strength and noise component strength is less than a first specific threshold.

With this constitution, since the specific adjustment amount is decreased in an environment with a large ratio between signal strength and noise component strength (that is, the SN ratio), ambient noise is harder to hear when there is no speech component, for example, and this enhances the comfort of the hearing aid user.

(3) Also, with the hearing aid pertaining to this embodiment, the adjustment amount calculator controls so as to increase the adjustment amount when the ratio is at or above a second specific threshold, which is at or above the first specific threshold.

With this constitution, since the specific adjustment amount is increased in an environment with a small ratio between signal strength and noise component strength (that is, the SN ratio), gain is increased only when there is a speech component, for example, which makes it easier to hear speech.

(4) Also, with the hearing aid pertaining to this embodiment, the adjustment amount calculator controls so that the adjustment amount is neither increased nor decreased when the ratio between signal strength and noise component strength is at or above the first specific threshold and is less than the second specific threshold.

With this constitution, in an environment in which the ratio between signal strength and noise component strength (that is, the SN ratio) is neither too large nor too small, there is no change to the adjustment amount, so a state in which speech is easy to hear can be maintained without any unnecessary operation.

(5) Also, with the hearing aid pertaining to this embodiment, the adjustment amount calculator sets the inverse of the noise suppression gain calculated for each specific time segment by the noise suppressor as the maximum value of the adjustment amount.

With this constitution, setting the adjustment amount to its maximum value allows the portion suppressed with noise suppression gain to be returned to the amplitude level of the input signal with the adjustment amount, and allows an output signal to be produced in which the speech component is clearer.

(6) Also, with the hearing aid pertaining to this embodiment, the adjustment amount calculator sets as the minimum value of the adjustment amount a value obtained by dividing the minimum value of noise suppression gain of the noise suppressor by the noise suppression gain calculated for each specific time segment.

With this constitution, setting the adjustment amount to the minimum value reduces discomfort experienced by the hearing aid user due to excessive gain suppression.

(7) Also, with the hearing aid pertaining to this embodiment, when the adjustment amount is increased, or when a speech segment is detected, the nonlinear compressor lengthens the time constant that controls the nonlinear compression gain in the direction of decreasing, and shortens the time constant that controls the nonlinear compression gain in the direction of increasing.

With this constitution, lengthening the time constant that controls the nonlinear compression gain in the direction of decreasing suppresses the cutoff of consonants at the start of speech signals, and shortening the time constant that controls the nonlinear compression gain in the direction of increasing emphasizes speech signals and prevents them from being missed by the user.

(8) Also, with the hearing aid pertaining to this embodiment, when the adjustment amount is decreased, or when a non-speech segment is detected, the nonlinear compressor shortens the time constant that controls the nonlinear compression gain in the direction of decreasing, and lengthens the time constant that controls the nonlinear compression gain in the direction of increasing.

With this constitution, shortening the time constant that controls the nonlinear compression gain in the direction of decreasing allows bursts of noise component to be suppressed in a short time, and lengthening the time constant that controls the nonlinear compression gain in the direction of increasing allows bursts of noise component to be suppressed in a short time even when occurring repeatedly.

(9) Also, with the hearing aid pertaining to this embodiment, the adjustment amount calculator sets the first specific threshold and second specific threshold so that the loudness levels will be constant for the various frequency bands.

With this constitution, controlling so that the loudness levels will be constant for the various frequency bands makes it possible for the hearing aid user to clearly hear speech in a way that suits the hearing of the user.

(10) Also, with the hearing aid pertaining to this embodiment, when the number of frequency band segments in the adjustment amount calculator is different from the number of frequency band segments in the nonlinear compressor, this nonlinear compressor controls the nonlinear compression gain with an average value of the adjustment amount in the frequency band segments of the adjustment amount calculator.

With this constitution, even if the number of frequency band segments differs between the nonlinear compressor and the adjustment amount calculator, an output signal in which the speech component is clearer can still be produced.

Second Embodiment

Next, the constitution of the hearing aid pertaining to the second embodiment of the present invention will be described. In FIG. 5, a modification example of just the portion corresponding to the frequency region processing means 104 in FIG. 1 is shown, with the rest of the portions being the same as in FIG. 1. The following description will be mainly about the difference from the first embodiment given above. This difference from the first embodiment is that the hearing aid pertaining to the second embodiment comprises a speech signal detector 501.

Speech Signal Detector 501

The speech signal detector 501 detects a speech segment that includes a speech component (non-noise component) in the input signal on the basis of the frequency power for each frequency band outputted from the frequency power calculator 124. A known speech detection method can be employed to this end, such as a method that makes use of MFCC (Mel Frequency Cepstral Coefficients) as the characteristic feature for performing speech detection, or a method that makes use of signal strength in the speech frequency band as the characteristic feature in order to reduce computation.

The "method for determining that an input sound is speech when the ratio of a vowel segment detected from an input sound to the input sound segment length is greater than a threshold" disclosed in Japanese Laid-Open Patent Application S62-17800, for example, can be used as a known speech detection method.

Another known speech detection method that can be used is the "method for determining whether sound is speech or non-speech by extracting a characteristic amount for a plurality of speech samples using a first-order autocorrelation coefficient and/or a second- or higher-order autocorrelation coefficient that characterizes speech, for every time period, from an input signal" disclosed in Japanese Laid-Open Patent Application H5-173592. Specifically, with the speech signal detector 501, information indicating that a segment to be processed is a speech segment (such as "1" or "on"), or information indicating that no speech signal is included, that is, that the segment to be processed is a non-speech segment (such as "0" or "off"), is outputted to a signal of a specific time period. This output functions as a speech detection flag (vad_flg). If neither a speech segment nor a non-speech segment is detected, the segment is considered uncertain.

Noise Suppressor 502

Figure 5:
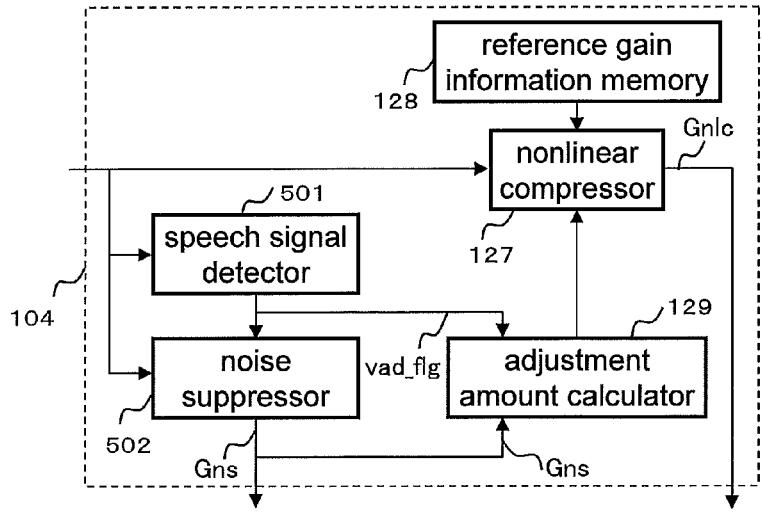
FIG. 5 is a block diagram illustrating an example of the constitution of a hearing aid pertaining to a second embodiment of the present invention.

The noise suppressor 502 shown in FIG. 5 is able to perform the following operation along with performing the operation of the noise suppressor 126 described in the first embodiment. The noise suppressor 502 calculates the noise suppression gain Gns on the basis of the SN ratio in the constitution in FIG. 1, and whether or not the detection result of the speech signal detector 501 is a speech segment. If it is a speech segment, the noise suppressor 502 increases the value of Gns, and if it is a non-speech segment, the value of Gns is reduced. Thus, the value of the noise suppression gain Gns is based on whether or not there is a speech segment, so the value of Gns is calculated from the speech component strength included in the input signal.

Operation of Adjustment Amount Calculator 129

Figure 6:
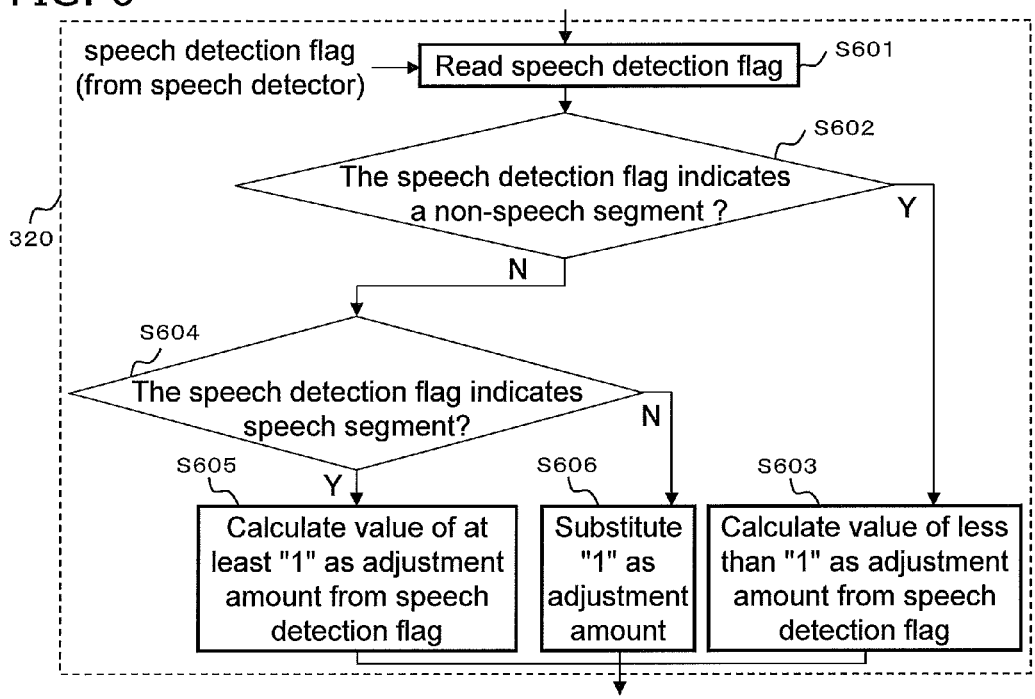
FIG. 6 is a flowchart illustrating an example of the operation of the adjustment amount calculator of the hearing aid pertaining to the second embodiment of the present invention.

Next, the operation of the adjustment amount calculator 129 will be described through reference to FIG. 6.

This operation is basically the same as the processing in FIG. 3, but the portion in which a comparison with the SN ratio is made (steps S301 to S306) is different. Just the differences from FIG. 3 will be described below. The differences are set forth in the adjustment amount calculation processing 320 in FIGS. 3 and 6.

First, a speech detection flag is acquired from the speech signal detector 501 (step S601). Then, it is determined whether or not the speech detection flag indicates a non-speech segment (step S602). If the speech detection flag indicates the non-speech segment, a value less than "1" is calculated from the speech detection flag as the adjustment amount (step S603). That is, the adjustment amount is reduced. On the other hand, if the speech detection flag does not indicate the non-speech segment, it is determined whether or not it is a speech segment (step S604). If the speech detection flag indicates the speech segment, a value of at least "1" is calculated from the speech detection flag as the adjustment amount (step S605). That is, the adjustment amount is increased. If the speech detection flag indicates the speech segment, the value "1" is substituted as the adjustment amount (step S606). That is, in this case the adjustment amount is neither increased nor decreased, and is treated as an uncertain segment that is neither a speech segment nor a non-speech segment.

Along with setting the minimum value of the adjustment amount in step S603, the maximum value of the adjustment amount may be set in step S605. Examples of methods for setting the minimum and maximum values of the adjustment amount are the same as those illustrated in FIG. 3. Specifically, segments for which it has been determined that the input signal is a non-speech segment are subjected to less amplification by the nonlinear compressor. Segments for which it has been determined that the input signal is a speech segment are restored to the amplification level of the input signal by the nonlinear compressor. Consequently, the speech component is attenuated as little as possible.

Next to be discussed is the operation of the nonlinear compressor 127 shown in FIG. 5, but this is the same as the processing in FIG. 4. In step S405 in FIG. 4, if the adjustment amount is added to the nonlinear compression gain, the default value of the adjustment amount is "0," the adjustment amount is made a positive value in the case of a speech segment, the adjustment amount is made a negative value in the case of a non-speech segment, and the adjustment amount is set to "0" in the case of an uncertain segment.

Thus, with the hearing aid pertaining to this embodiment, combining noise suppression processing with nonlinear compression processing allows the speech output to be optimally controlled according to the speech segments, non-speech segments, etc., of the input signal, and allows amplification of suppressed noise to be prevented.

Action and Effect (1) The hearing aid pertaining to this embodiment comprises a speech signal detector that detects speech segments of input signals, and an adjustment amount calculator controls the adjustment amount on the basis of whether or not a speech segment is detected.

With this constitution, since the adjustment amount is controlled on the basis of detection of a speech segment, the gain can be changed according to whether or not speech is involved, making it possible to provide a more comfortable hearing aid environment.

(2) Also, with the hearing aid pertaining to this embodiment, the adjustment amount calculator controls so as to increase the adjustment amount when a speech segment has been detected by the speech signal detector.

With this constitution, since the adjustment amount is increased when a speech segment is detected, the gain can be increased only when there is a speech segment, for example, making it easier to hear speech.

Also, with the hearing aid pertaining to this embodiment, the adjustment amount calculator controls so as to decrease the adjustment amount when a non-speech segment has been detected by the speech signal detector.

With this constitution, since the adjustment amount is decreased when a non-speech segment is detected, ambient noise is harder to hear, and the comfort of the hearing aid user can be enhanced.

Also, with the hearing aid pertaining to this embodiment, the adjustment amount calculator controls so that the adjustment amount is neither increased nor decreased when the segment detected by the speech signal detector is an uncertain segment with which it is unclear whether or not it is a speech segment.

With this constitution, since the control is such that the adjustment amount is not changed when an uncertain segment is detected with which it is unclear whether it is a speech segment or a non-speech segment, it is possible to maintain a state in which speech can be clearly heard, without performing unnecessary operation.

Third Embodiment

Figure 7:
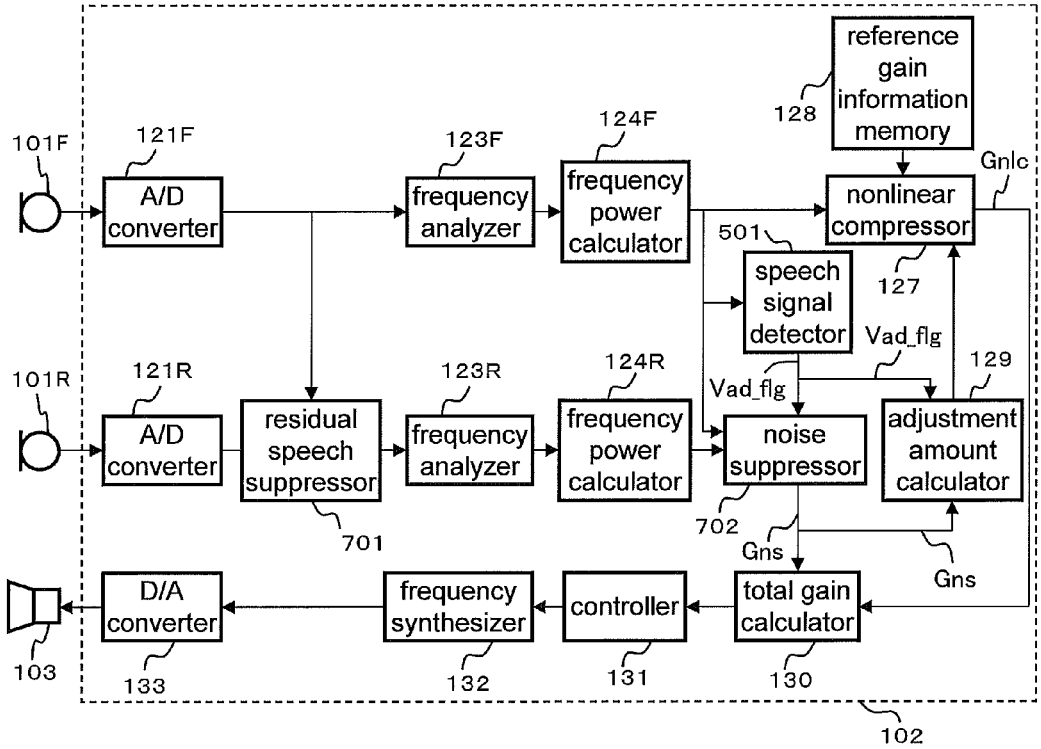
FIG. 7 is a flowchart illustrating an example of the operation of the adjustment amount calculator of the hearing aid pertaining to the third embodiment of the present invention.

FIG. 7 is a diagram of the constitution of the hearing aid pertaining to a third embodiment of the present invention. In FIG. 7, those constituent elements that are the same as in the hearing aid pertaining to the first embodiment shown in FIG. 1 are numbered the same. The differences from the first embodiment above will mainly be described here.

Constitution of Hearing Aid

The hearing aid pertaining to this embodiment has a microphone 101F and a microphone 101R that produce input signals from input sounds, a signal processing means 102 for producing an output signal by subjecting the input signal to specific signal processing, and a receiver 103 that reproduces an output sound from the output signal.

The signal processing means 102 has an A/D converter 121F, an A/D converter 121R, a speech signal detector 501, a residual speech suppressor 701, a frequency analyzer 123F, a frequency analyzer 123R, a frequency power calculator 124F, a frequency power calculator 124R, a noise suppressor 702, a nonlinear compressor 127, a total gain calculator 130, a controller 131, a frequency synthesizer 132, and a D/A converter 133.

The A/D converter 121F converts an input signal from the microphone 101F into an input signal. The A/D converter 121R converts an input signal from the microphone 101R into an input signal. In this embodiment, the input signal from the microphone 101F is called the main signal, while the input signal from the microphone 101 is called the reference signal.

The residual speech suppressor 701 inputs the main signal and the reference signal and performs specific processing to calculate the noise component strength of the reference signal. More specifically, the residual speech suppressor 701 first applies a specific, suitable filter to the main signal, and calculates the noise component strength of the main signal.

The residual speech suppressor 701 then subtracts the noise component strength of the main signal from the signal strength of the main signal to calculate the signal component strength of the main signal.

Then, taking into account the fact that the microphones 101F and 101R are disposed in different positions, the residual speech suppressor 701 subtracts the product of multiplying the signal component strength of the main signal by a specific coefficient from the reference signal strength. Here, the noise component strength of the reference signal, which is the output of the residual speech suppressor 701, is also called the CTC (cross-talk canceller) output.

The frequency analyzer 123F and the frequency analyzer 123R acquire the noise component of the main signal or the reference signal, and convert a time region signal into a frequency region signal by FFT, for example.

The frequency power calculator 124F calculates the power (signal strength) for each frequency with respect to the frequency region signal from the frequency analyzer 123F. The frequency power calculator 124R calculates the power (signal strength) for each frequency with respect to the frequency region signal from the frequency analyzer 123R. The power here is calculated as the average signal power for a specific, short time.

The speech signal detector 501 detects a sound segment that includes a speech component (non-noise component) from the signal power for each frequency calculated by the frequency power calculator 124F. The speech signal detector 501 outputs information indicating that a speech component is included, that is, that the segment is a speech segment (such as "1" or "on"), or information indicating that a speech component is not included, that is, that the segment is a non-speech segment (such as "0" or "off"). This output functions as a speech detection flag.

The noise suppressor 702 calculates the noise suppression gain Gns on the basis of whether or not the detection result of the speech signal detector 501 is a speech segment, the steady noise component, and the non-steady noise component. An example of a method for estimating the steady noise component and the non-steady noise component is disclosed in Japanese Laid-Open Patent Application 2004-187283. The noise suppression gain Gns can be calculated as Gns=((signal noise component−steady noise component−non-steady noise component)−signal noise component).

The noise suppression gain Gns here satisfies the relation $0<Gns\leqq 1$. Also, the setting of the maximum and minimum values for the noise suppression gain Gns is the same as described above.

The noise suppressor 702 also performs suppression processing so as to attenuate the strength of the noise component of the main signal. For instance, performing Wiener filtering or spectrum subtraction as the noise suppression processing is the same as described above.

The nonlinear compressor 127 calculates the nonlinear compression gain Gnlc on the basis of the signal power of the input signal of the main signal for each frequency band from the frequency power calculator 124, the noise component strength from the noise suppressor 702, and a gain table stored in a memory (not shown).

The processing of FIG. 4 is performed in the same manner as in the first embodiment with the nonlinear compressor 127 of the hearing aid pertaining to this embodiment. Also, just as in the first embodiment, the gain Gnlc may be controlled so as to increase or decrease on the basis of whether or not a segment is a speech segment, or the SN ratio, instead of using the noise component strength.

Action and Effect (1) The hearing aid pertaining to this embodiment a plurality of microphones, and the noise suppressor estimates for each frequency band the steady noise component and the non-steady noise component as the noise component strength, on the basis of the various signal strengths of the input signals produced by the microphones.

With the above constitution, since the steady noise component strength and the non-steady noise component strength are estimated, noise suppression processing and nonlinear compression processing are combined so that speech output can be optimally controlled according to the speech component, the steady noise component, and the non-steady noise component, and so that suppressed steady noise and non-steady noise can be prevented from being amplified.

Simulation Results

An example of simulation results with the hearing aid pertaining to this hearing aid will now be described through reference to FIGS. 9 to 12.

FIG. 9 consists of simulation results related to the overall operation of the hearing aid pertaining to this embodiment.

Figure 9A:
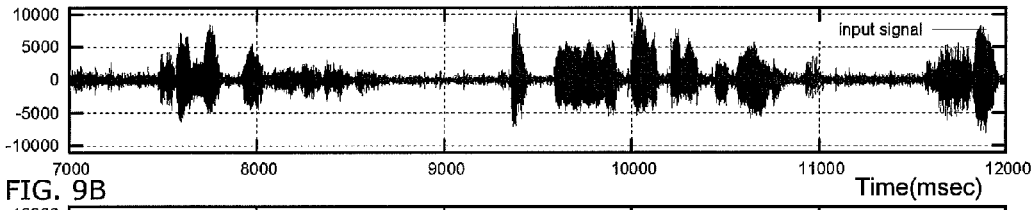
FIGS. 9A to 9G are examples of simulation results related to the overall operation of the hearing aid pertaining to the third embodiment of the present invention.

FIG. 9A shows the input signal for the main signal inputted to the hearing aid pertaining to this embodiment.

Figure 9B:
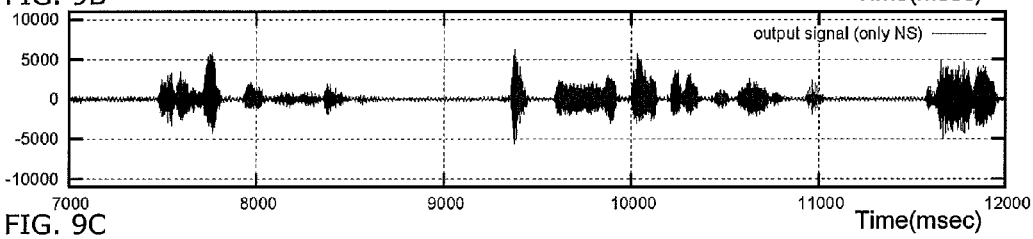

FIG. 9B is the output signal (only NS) in a conventional hearing aid. FIG. 9B shows a case in which only noise suppression processing (NS) is performed for suppressing the noise component included in the main signal, and the amplitude of the speech signal is reduced by noise suppression processing.

Figure 9C:
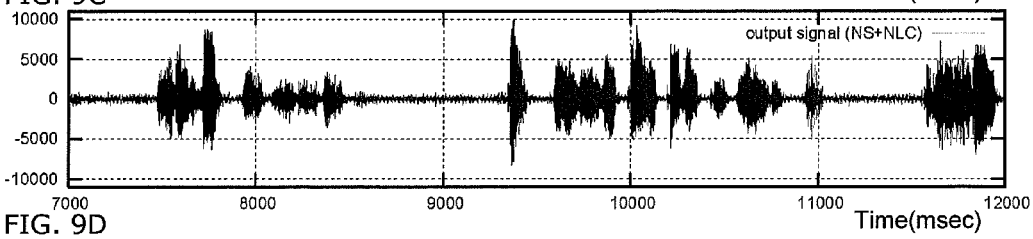

FIG. 9C is the output signal (NS+NLC) of the hearing aid pertaining to this embodiment. FIG. 9C shows a case in which nonlinear compression processing (NLC), in which the main signal is amplified with a different gain (amplification ratio) for each frequency band, is performed after the performance of noise suppression processing (NS). In FIG. 9C, the input/output amplitudes are compared, speech is kept at substantially the same signal strength, and noise is suppressed. This expresses the effect of the present invention.

Figure 9D:
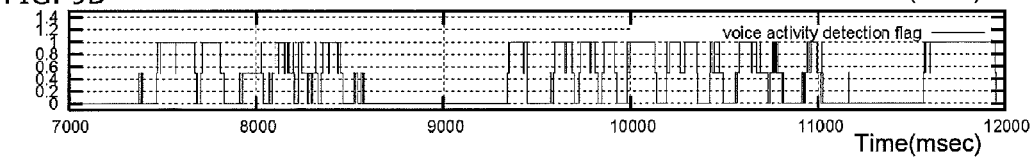

FIG. 9D shows a speech detection flag (voice activity detection flag), which is intermediate data.

Figure 9E:
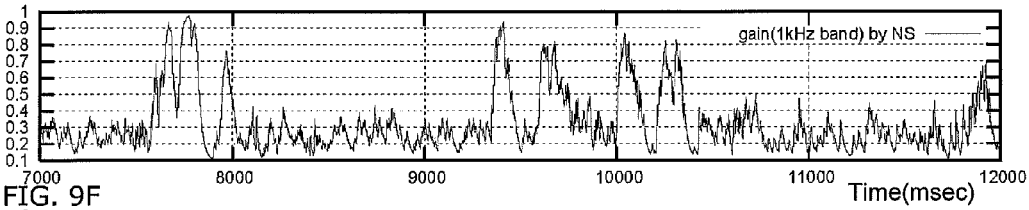
Figure 9F:
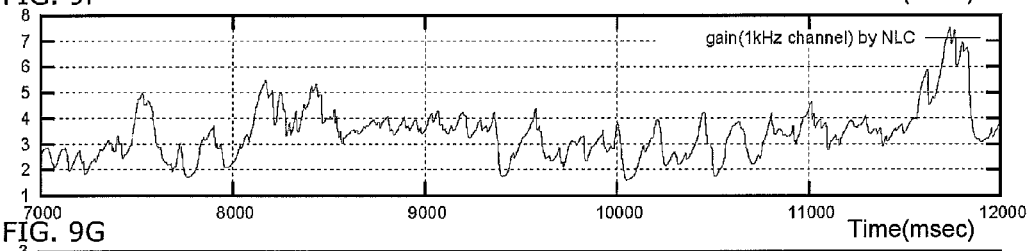
Figure 9G:
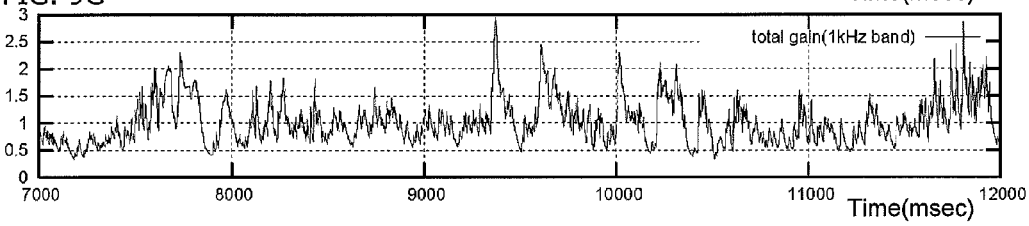
Figure 10A:
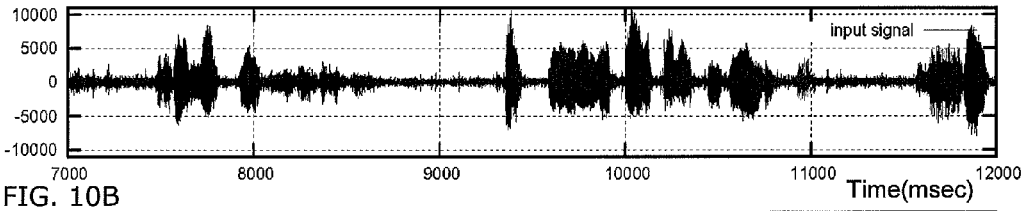
FIGS. 10A to 10H are examples of simulation results related to the noise suppressor of the hearing aid pertaining to the third embodiment of the present invention.
Figure 10B:
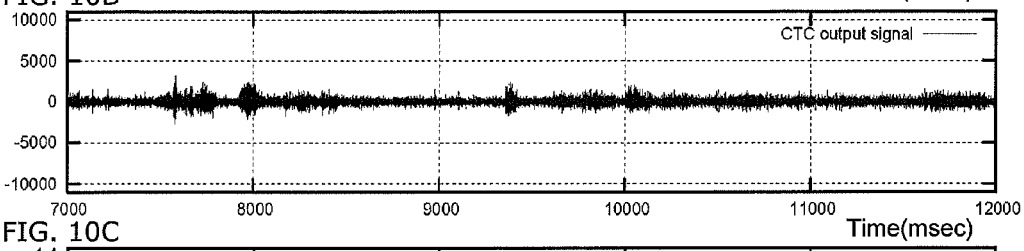
Figure 10C:
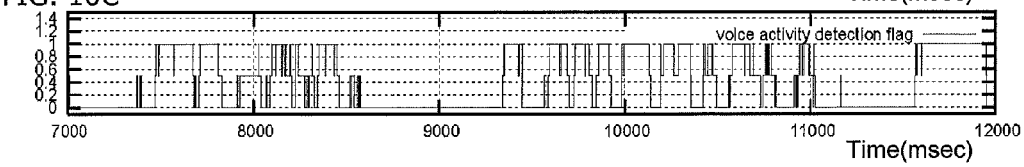
Figure 10D:
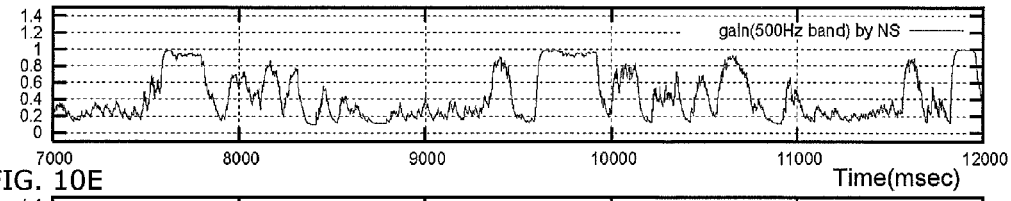
Figure 10E:
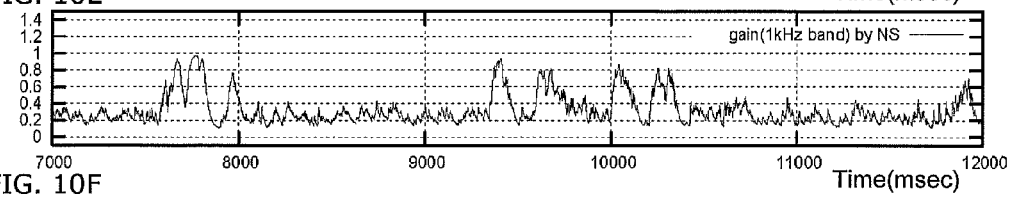
Figure 10F:
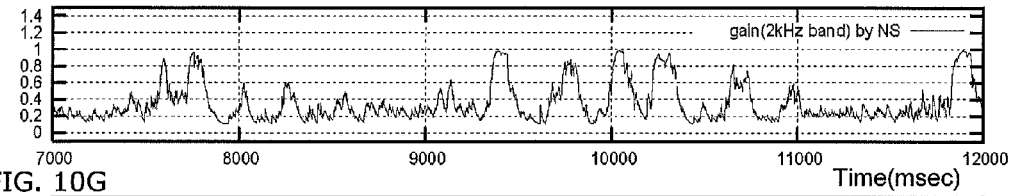
Figure 10G:
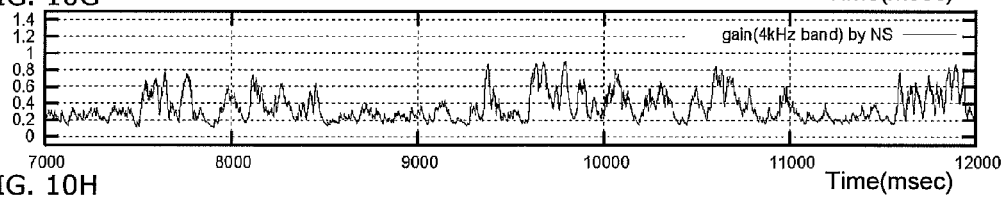
Figure 10H:
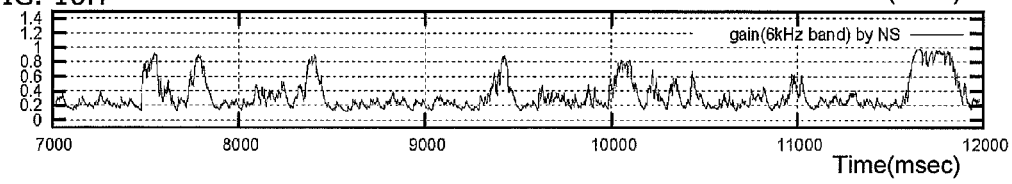
Figure 11A:
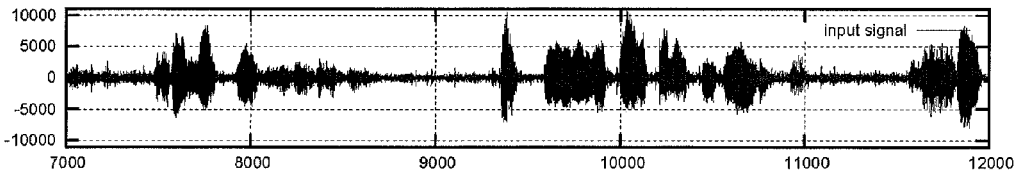
FIGS. 11A to 11G are examples of simulation results related to the nonlinear compressor of the hearing aid pertaining to the third embodiment of the present invention.
Figure 11B:
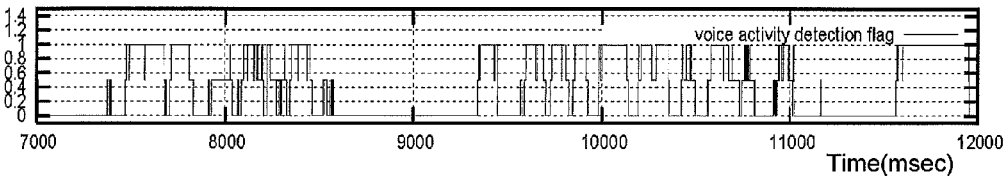
Figure 11C:
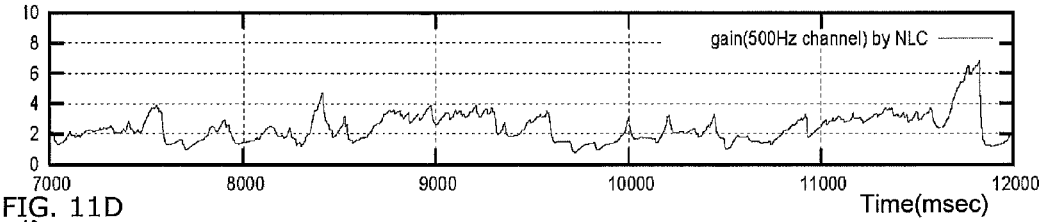
Figure 11D:
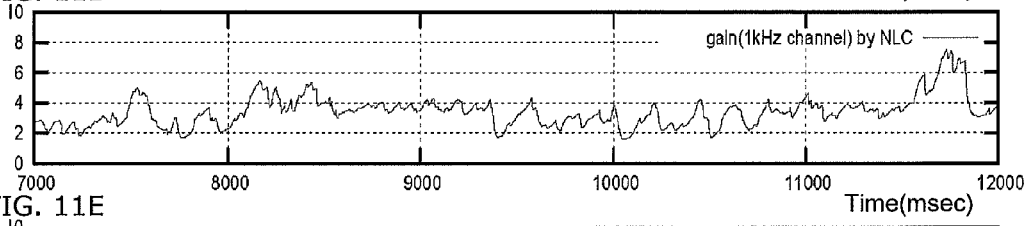
Figure 11E:
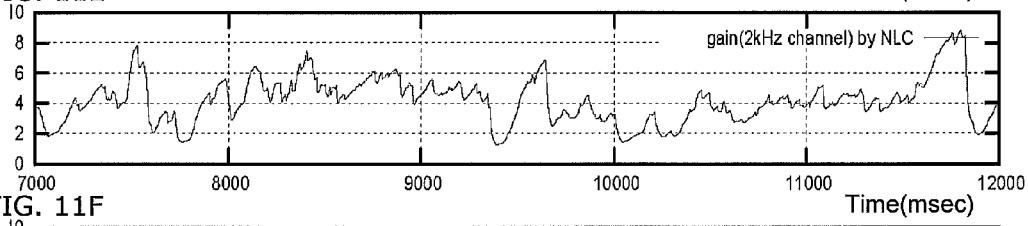
Figure 11F:
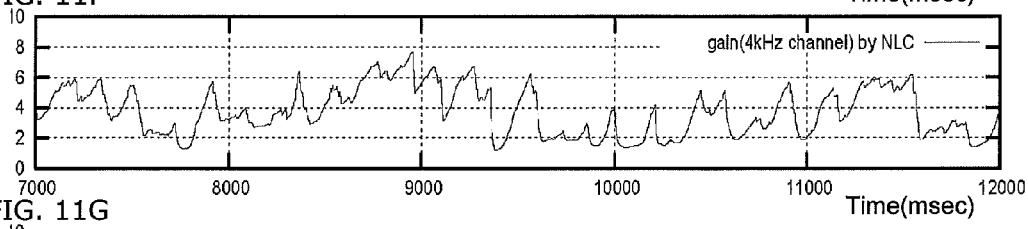
Figure 11G:
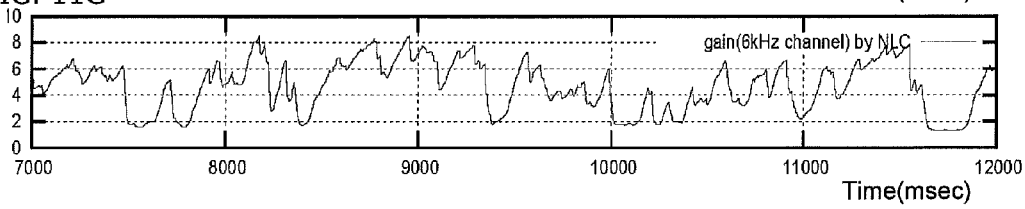
Figure 12A:
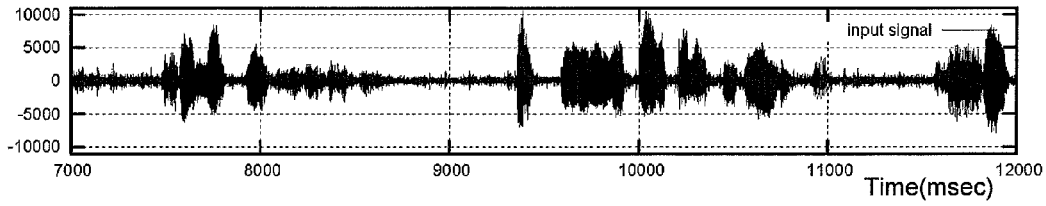
FIGS. 12A to 12H are examples of simulation results related to a total gain calculator of the hearing aid pertaining to the third embodiment of the present invention.
Figure 12B:
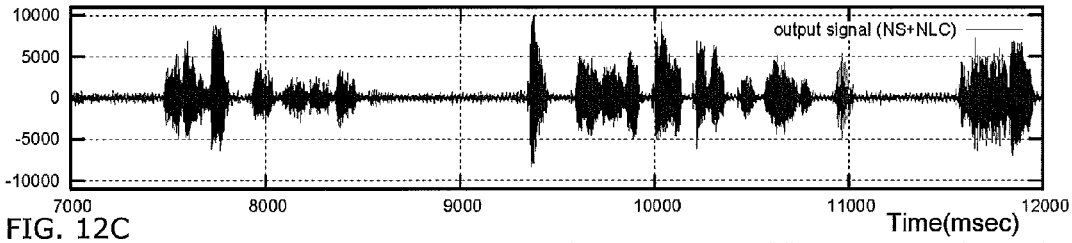
Figure 12C:
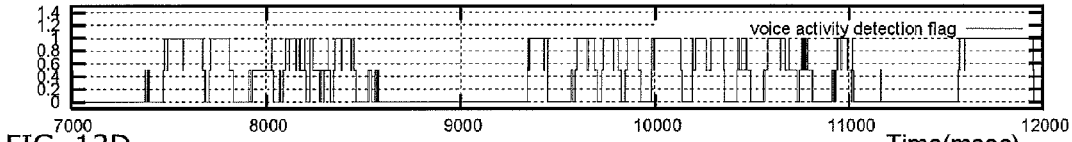
Figure 12D:
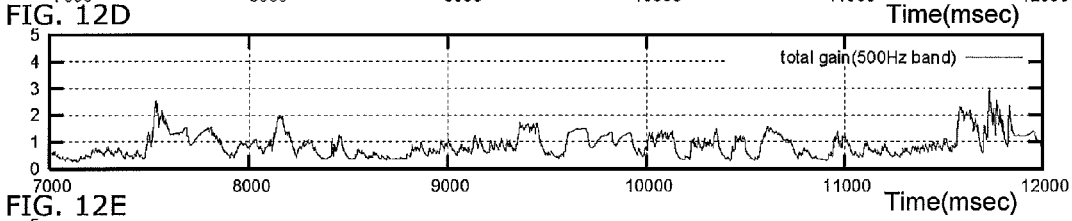
Figure 12E:
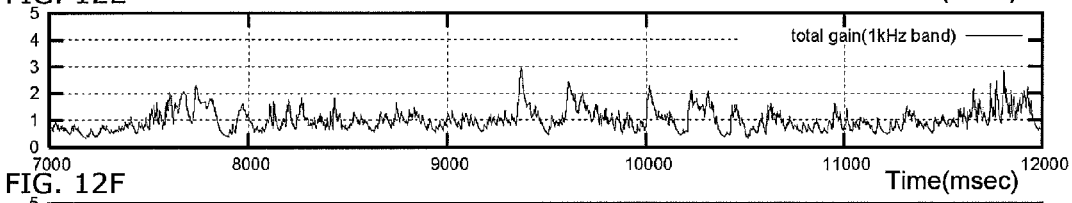
Figure 12F:
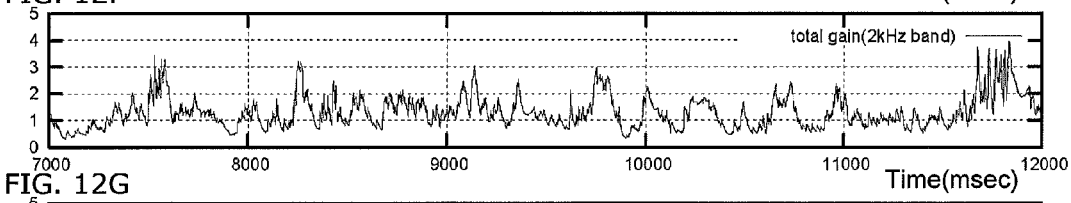
Figure 12G:
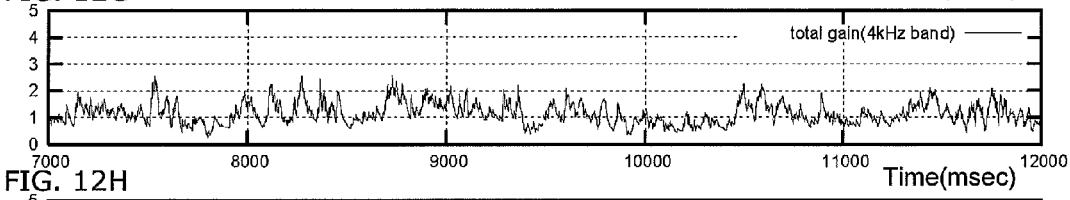
Figure 12H:
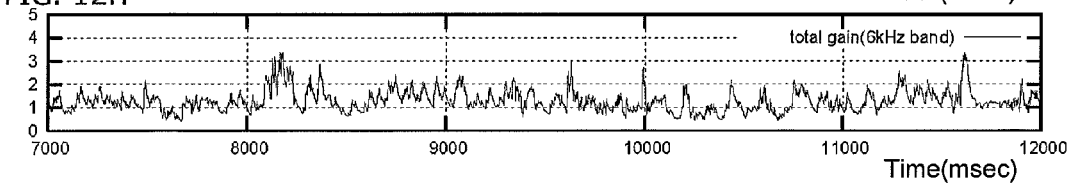

FIGS. 9E to 9G each show intermediate data. FIG. 9E shows the noise suppression gain Gns (gain by NS) resulting from the noise suppressor 702.

FIG. 9F shows the gain Gnlc (gain by NLC) resulting from the nonlinear compressor 127. FIG. 9G shows the total gain G resulting from the total gain calculator 130. Here, the noise suppression gain Gns, gain Gnlc, and total gain G with respect to the 1 kHz band are shown as an example.

FIG. 10 shows simulation results related to the noise suppressor 702. FIG. 10A shows an input signal of the main signal of the hearing aid pertaining to this embodiment. FIG. 10B shows CTC output, which is the output of the residual speech suppressor 701. FIG. 10C shows a speech detection flag, which is the output of the speech signal detector 501. FIGS. 10D to 10H show the noise suppression gain Gns (gain by NS) resulting from the noise suppressor 702 for each frequency band (500, 1000, 2000, 4000, 6000 Hz).

FIG. 11 shows simulation results related to the nonlinear compressor 127. FIG. 11A shows the input signal of the main signal of the hearing aid pertaining to this embodiment. FIG. 11B shows a speech detection flag. FIGS. 11C to 11G show the gain Gnlc (gain NLC) of the nonlinear compressor 127 for each frequency band (500, 1000, 2000, 4000, 6000 Hz). A band in which a plurality of bands is combined is referred to herein as a channel.

FIG. 12 shows simulation results related to the total gain calculator 130. FIG. 12A shows the input signal of the main signal of the hearing aid pertaining to this embodiment. FIG. 12B shows the output signal of the hearing aid pertaining to this embodiment. FIG. 12C shows a speech detection flag. FIGS. 12D to 12H shows the total gain G of the total gain calculator 130 for each frequency band (500, 1000, 2000, 4000, 6000 Hz).

As described above, with the hearing aid pertaining to this embodiment, when noise suppression processing and nonlinear compression processing are combined, speech can be heard more clearly by controlling the output according to noise and the desired signal.

In particular, since the hearing aid of this embodiment comprises a plurality of microphones, the steady noise component and non-steady noise component included in the speech signals inputted from the plurality of microphones can be detected and suppressed. Accordingly, the precision at which just the speech signal is amplified can be increased. Therefore, the signal strength of the speech signal can be controlled more accurately. As a result, even with wearers whose hearing varies greatly with just a minor change in sound volume due to a phenomenon called recruitment, discomfort caused by changes in sound volume can be lessened.

The present invention can be utilized as a hearing aid with which speech can be clearly heard, which is achieved by combining noise suppression processing and nonlinear compression processing, and controlling the output according to noise and the desired signal.

REFERENCE SIGNS LIST

101, 101F, 101R microphone
102 signal processing means
103 receiver
104 frequency region processing means
121, 121F, 121R A/D converter
123, 123F, 123R frequency analyzer
124, 124F, 124R frequency power calculator
126 noise suppressor
127 nonlinear compressor
128 reference gain information memory
129 adjustment amount calculator
130 total gain calculator
131 controller
132 frequency synthesizer
133 D/A converter
320 adjustment amount calculation processing
501 speech signal detector
502 noise suppressor
701 residual speech suppressor
702 noise suppressor

The invention claimed is:

1. A hearing aid, comprising:

a microphone producing an input signal from an input sound;

a noise suppressor estimating a noise component strength included in the input signal on the basis of signal strength for each of a plurality of frequency bands in the input signal, and calculating for each of the plurality of frequency bands a noise suppression gain for suppressing a noise component included in the input signal on the basis of the noise component strength;

an adjustment amount calculator calculating an adjustment amount on the basis of the signal strength and the noise component strength;

a reference gain information memory storing specific reference gain information;

a nonlinear compressor calculating a reference gain on the basis of the signal strength and the specific reference gain, and adjusting the reference gain on the basis of the adjustment amount, and thereby calculating for each of the plurality of frequency bands a nonlinear compression gain for nonlinearly compressing and amplifying the input signal;

a controller producing an output signal by controlling the input signal on the basis of the noise suppression gain and the nonlinear compression gain; and a receiver reproducing an output sound from the output signal.

2. The hearing aid according to claim 1, wherein the adjustment amount calculator decreases the adjustment amount when a ratio between the signal strength and the noise component strength is less than a first specific threshold.

3. The hearing aid according to claim 2, wherein the adjustment amount calculator increases the adjustment amount when the ratio between the signal strength and the noise component strength is at or above a second specific threshold that is at or above the first specific threshold.

4. The hearing aid according to claim 3, wherein the adjustment amount calculator does not increase or decrease the adjustment amount when the ratio between the signal strength and the noise component strength is at or above the first specific threshold and is less than the second specific threshold.

5. The hearing aid according to claim 1, further comprising a speech signal detector detecting a speech segment of the input signal, wherein the adjustment amount calculator controls the adjustment amount on the basis of whether or not the speech segment is detected by the speech signal detector.

6. The hearing aid according to claim 5, wherein the adjustment amount calculator increases the adjustment amount when the speech segment is detected by the speech signal detector.

7. The hearing aid according to claim 5, wherein the adjustment amount calculator decreases the adjustment amount when a non-speech segment is detected by the speech signal detector.

8. The hearing aid according to claim 5, wherein the adjustment amount calculator does not increase or decrease the adjustment amount when an uncertain segment, for which it is unclear whether or not it is the speech segment, is detected by the speech signal detector.

9. The hearing aid according to claim 1, wherein the adjustment amount calculator sets as a maximum value of the adjustment amount an inverse of the noise suppression gain calculated for each specific time segment by the noise suppressor.

10. The hearing aid according to claim 1, wherein the adjustment amount calculator sets as a minimum value of the adjustment amount a value obtained by dividing a minimum value of the noise suppression gain by the noise suppression gain.

11. The hearing aid according to claim 3, wherein, when the adjustment amount calculator increases the adjustment amount, the nonlinear compressor lengthens a time constant controlling the nonlinear compression gain in a direction of decreasing, and shortens a time constant controlling the nonlinear compression gain in a direction of increasing.

12. The hearing aid according to claim 2, wherein, when the adjustment amount calculator decreases the adjustment amount, the nonlinear compressor shortens a time constant controlling the nonlinear compression gain in a direction of decreasing, and lengthens a time constant controlling the nonlinear compression gain in a direction of increasing.

13. The hearing aid according to claim 3, wherein the adjustment amount calculator sets the first specific threshold and the second specific threshold so that there will be a constant loudness level for each of the plurality of frequency bands.

14. The hearing aid according to claim 1, wherein the adjustment amount calculator calculates as the adjustment amount a plurality of adjustment amounts in different segments from the plurality of frequency bands, and the nonlinear compressor controls the nonlinear compression gain on the basis of the average value of the plurality of adjustment amounts.

15. The hearing aid according to claim 1, wherein the microphone is composed of a plurality of microphones, and the noise suppressor estimates, as the noise component strength, a steady-state noise component strength and a non-steady-state noise component strength for each of the plurality of frequency bands on the basis of the signal strengths of the plurality of input signals produced by the plurality of microphones.

16. The hearing aid according to claim 3, wherein the adjustment amount calculator sets the first specific threshold and the second specific threshold higher on a low frequency band side than on a high frequency band side.

17. The hearing aid according to claim 3, wherein the adjustment amount calculator sets the first specific threshold and the second specific threshold on the basis of the ratio between the signal strength of a low frequency band side and the noise component strength of the low frequency band side.

18. The hearing aid according to claim 3, wherein the adjustment amount calculator sets the first specific threshold and the second specific threshold on the basis of the ratio between the signal strength of a low frequency band side and the noise component strength of the low frequency band side.

19. The hearing aid according to claim 1, wherein the adjustment amount calculator calculates as the adjustment amount a plurality of adjustment amounts for each of the plurality of frequency bands, and the plurality of adjustment amounts include a first adjustment amount and a second adjustment amount being larger than the first adjustment amount.

20. The hearing aid according to claim 1, wherein the adjustment amount calculator calculates as the adjustment amount a plurality of adjustment amounts for each of the plurality of frequency bands, and the plurality of adjustment amounts include a first adjustment amount having a first minimum value, and a second adjustment amount having a second minimum value being larger than the first minimum value.

* * * * *